US005542021A

United States Patent [19]

Hopper et al.

[11] Patent Number: 5,542,021

[45] Date of Patent: Jul. 30, 1996

[54] STEAM GENERATOR

[75] Inventors: Timothy Hopper, Normandy; Leslie M. Bellamy, deceased, late of Blackheath, England, by Miss A. M. Howard, executrix

[73] Assignee: Earlex Limited, Surrey, United Kingdom

[21] Appl. No.: 190,015

[22] PCT Filed: Jun. 9, 1992

[86] PCT No.: PCT/GB92/01029

§ 371 Date: Jul. 15, 1994

§ 102(e) Date: Jul. 15, 1994

[87] PCT Pub. No.: WO92/22771

PCT Pub. Date: Dec. 23, 1992

[30] Foreign Application Priority Data

Jun. 19, 1991 [GB] United Kingdom ..... 9113296

[51] Int. Cl.[6] ..... F17C 7/04

[52] U.S. Cl. ..... 392/403

[58] Field of Search ..... 392/394, 400–404, 392/324–25, 323; 126/361, 363; 122/13.1, 13.2, DIG. 10

[56] References Cited

U.S. PATENT DOCUMENTS

| | | | |
|---|---|---|---|
| 310,276 | 1/1885 | Hayes | 122/13.1 |
| 444,693 | 1/1891 | Creque | 122/13.1 |
| 1,114,404 | 10/1914 | Smith | 392/403 |
| 2,060,638 | 11/1936 | Schlosser | 392/403 |
| 2,572,317 | 10/1951 | Chausse | 392/403 |
| 2,627,055 | 1/1953 | Hackman | 392/403 |
| 2,880,300 | 3/1959 | Reimers | 392/403 |
| 2,886,689 | 5/1959 | Garth | 392/403 |
| 3,025,381 | 4/1962 | Pickering . | |
| 3,291,964 | 12/1966 | Williams . | |
| 3,472,455 | 10/1969 | Johnson | 393/403 |
| 3,793,753 | 2/1974 | Engelbart | 392/404 |
| 4,494,485 | 1/1985 | Kendall . | |
| 5,305,415 | 4/1994 | Stevens | 392/403 |

FOREIGN PATENT DOCUMENTS

| | | |
|---|---|---|
| 1060519 | 8/1979 | Canada . |
| 1265757 | 5/1961 | France . |
| 8915457 | 7/1990 | Germany . |
| 2029884 | 3/1980 | United Kingdom . |

OTHER PUBLICATIONS

Foreign Abstract Search.

*Primary Examiner*—Teresa J. Walberg
*Assistant Examiner*—Sam Paik
*Attorney, Agent, or Firm*—Ware, Fresssola, Van Der Sluys & Adolphson

[57] ABSTRACT

A steam generator for a wall paper steamer having a two section boiler (2, 3). The sections are of light alloy and are secured together with adhesive at a spigot and socket joint (4, 5). The boiler is mounted in a framework of lightweight aluminum tube, having two trapezium ends and interconnecting members. The boiler is secured to bottom members (46). Top members (47) support a stepping board (49).

14 Claims, 4 Drawing Sheets

STEAM GENERATOR

BACKGROUND OF THE INVENTION

1. Field of the Invention

The present inventions relates to a hand portable steam generator, particularly, though not exclusively, for use in a wallpaper steamer.

2. Description of the Prior Art

Most rooms have a ceiling height just too high for a decorator to reach to the top of the wall or the ceiling for decoration and in particular for stripping wallpaper from it.

SUMMARY OF THE INVENTION

The object of the present invention is to provide a steam generator which is adapted to be stood on so that the decorator can reach the ceiling.

A hand portable steam generator of the invention comprises a boiler mounted within a framework, the framework being adapted to be stood on.

Preferably the framework has a stepping board mounted at its top for standing on.

The preferred framework comprises a pair of generally planar frames, which are interconnected by spacing members. Two spacing members at a top side of the frames provide support for the step and two spacing members at a bottom side of the frames support the boiler.

Preferably, the frames are of metal tube, one end of the tube of each frame being tucked in the other end of the tube and the ends being arranged between the bottom spacing members, the arrangement being such that securement of the boiler to the bottom spacing members prevents the tucked joints opening.

Preferably, the boiler is a section piece casting of light alloy, with a socket-and-spigot joint, secured by adhesive. Additional mechanical securement may be provided.

Normally the steam generator will be supplied in combination with a steam plate having an apertured steam dispersion tube extending on the underside of the steam plate from a steam hose connection fitting.

To help understanding of the invention, a specific embodiment thereof will now be described with reference to the accompanying drawings, in which;

DESCRIPTION OF THE BEST MODE OF THE INVENTION

Figure 1:
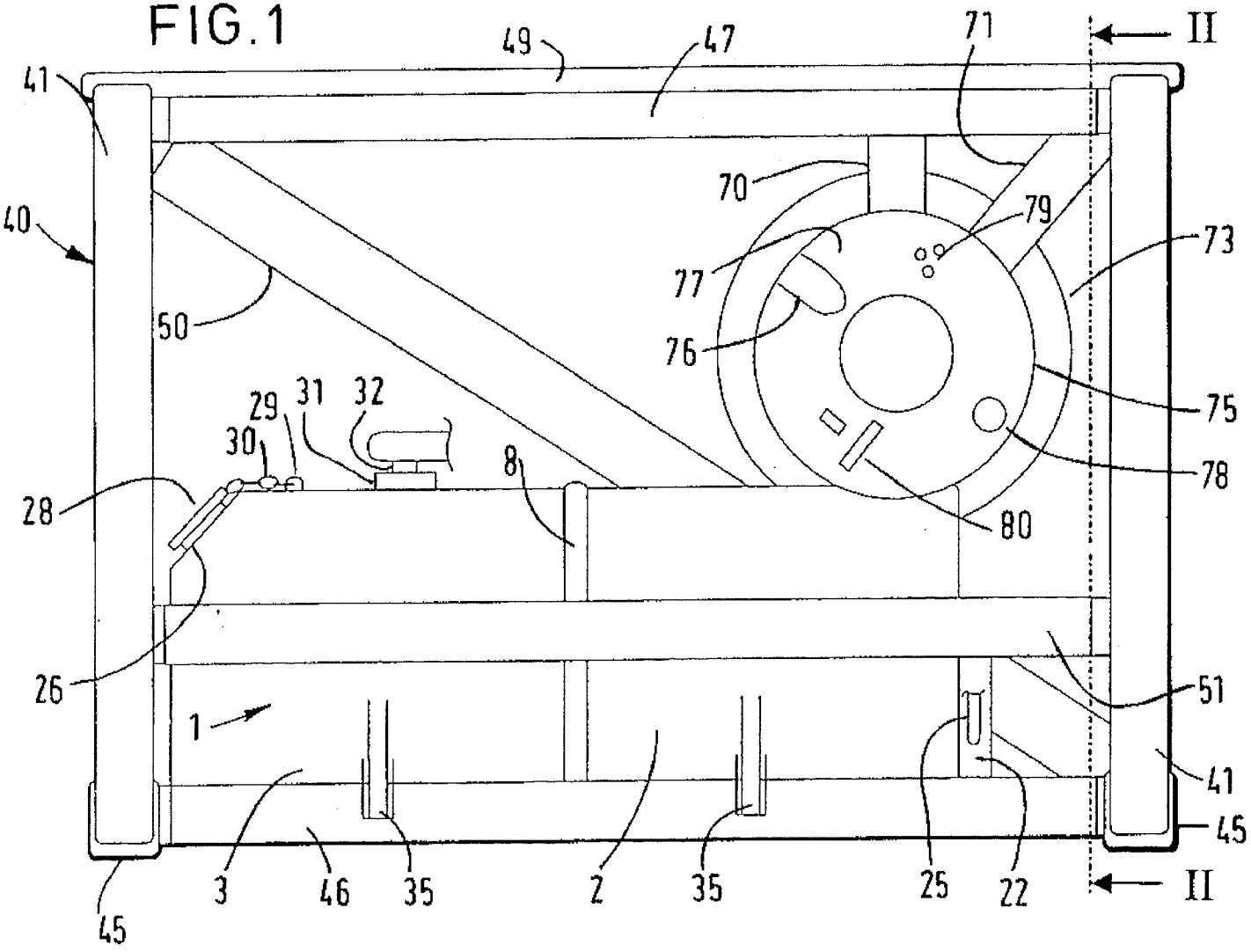
FIG. 1 is a side view of a steam generator of the invention.
Figure 2:
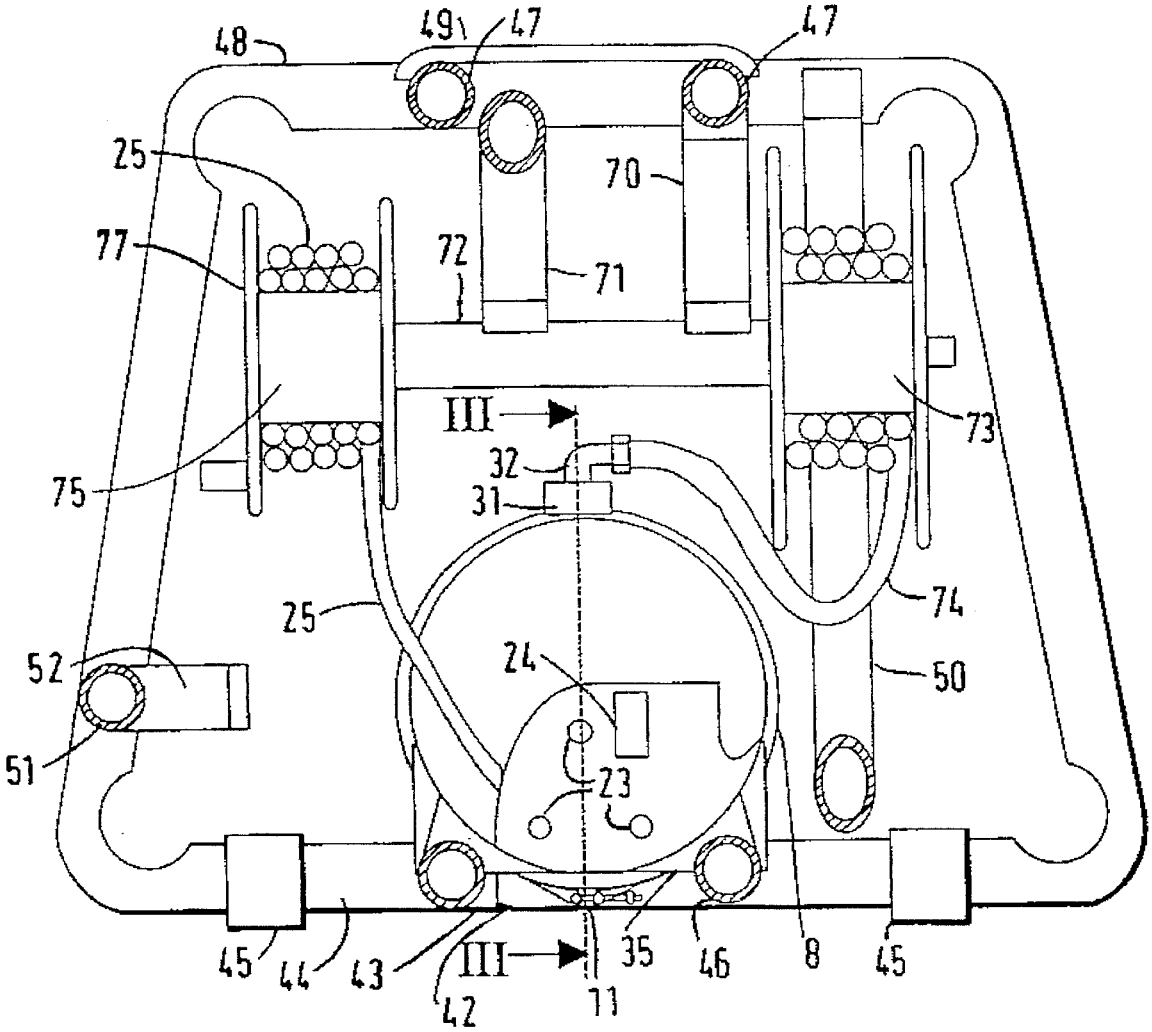
FIG. 2 is a cross-sectional end view on the line II—II of the steam generator of FIG. 1.
Figure 3:
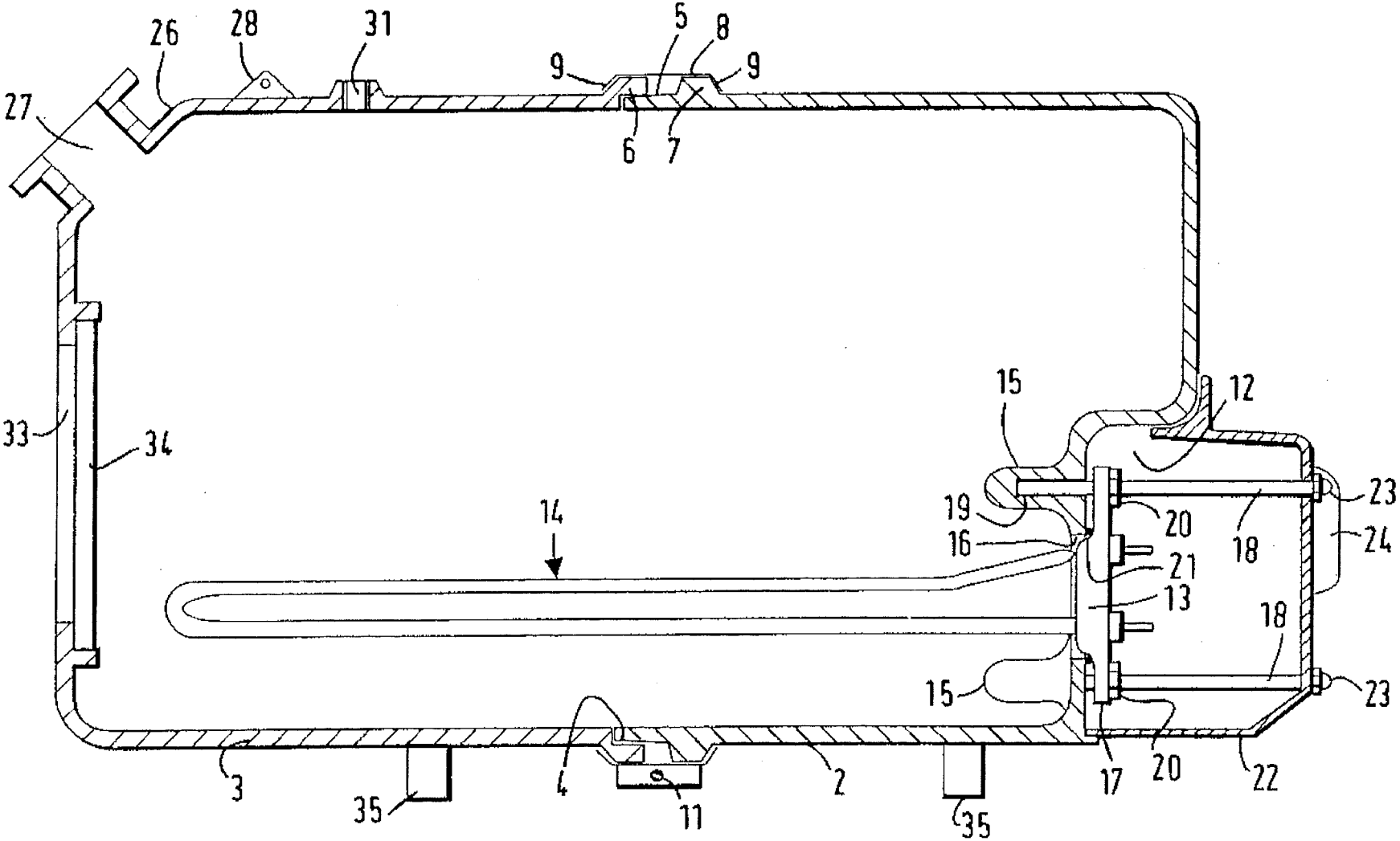
FIG. 3 is a cross-sectional side view on the line III—III of the boiler of the steam generator.
Figure 4:
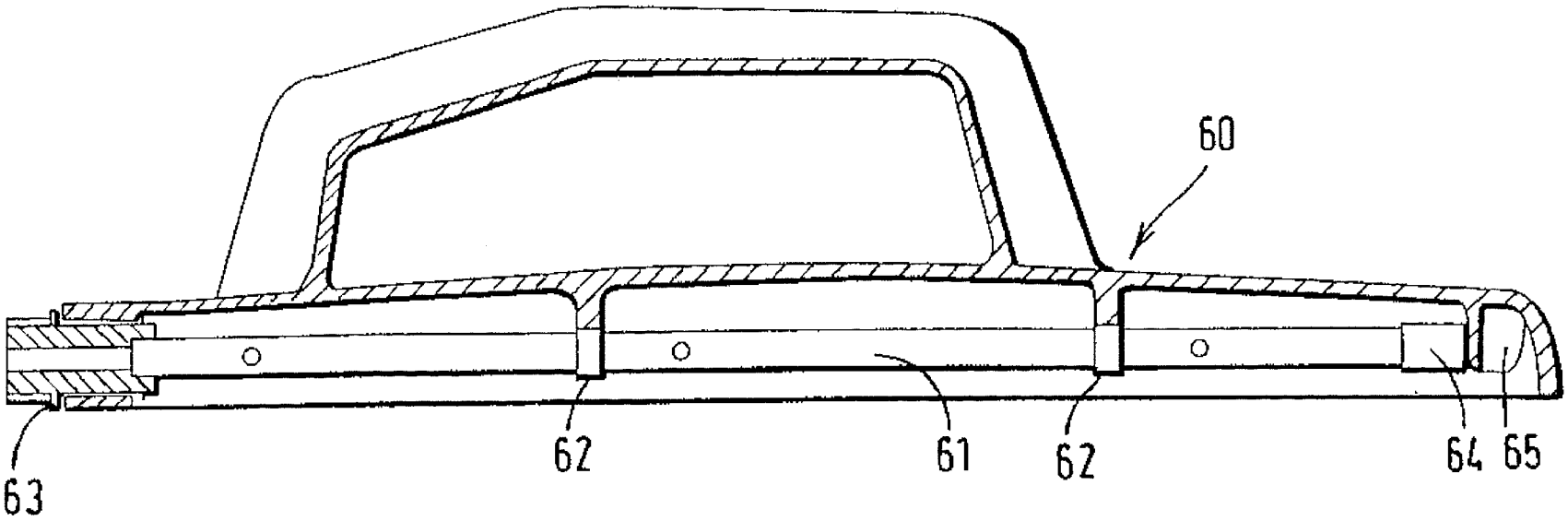
FIG. 4 is a cross-sectional side view of a steam plate for use with the steam generator.

The hand portable steam generator shown in the drawings has a high-pressure aluminium die cast boiler 1. The boiler 1 has two sections 2,3. Section 3 has a socket 4 (as shown in FIG. 3) at its open end; whilst section 2 has a spigot open end 5. The spigot end 5 is received in the socket end 4 and fixed there by a silicone sealing adhesive, which secures the two sections together in a pressure-tight manner. As added mechanical security against bursting of the boiler at this adhesive joint, the two sections are provided with ribs 6,7 adjacent their ends. A shallow U-section steel band 8 surrounds the joint and engages the two sections 2,3 with its flanges 9. The band is tightened by a screw fitting 11, beneath the boiler.

The section 2 has a recess 12 in its closed end for accommodating the end fitting 13 of an electrical heating element 14 for boiling water in the boiler. At the recess, three bosses 15—of which two only are visible in FIG. 3—extend inwardly from the recess 12. The bosses are centred around an opening 16, through which the heating element extends. The fitting has an integral flange 17, which is apertured for three threaded rods 18. The latter are received in blind threaded bores 19 in the bosses 15. Nuts 20 on the rods 18 captivate an O-ring 21 between the boiler section and the flange 17, whereby the boiler is sealed at the element, the bores 18 being blind. A plastics material cover 22 conceals the recess 12. The cover is secured by further nuts 23 on the ends of the rods. An electrical supply switch 24 is mounted on the cover 22. Electrical connections to a supply cable 25 are made within the cover.

At an angled top end portion 26, the boiler section 3 has a filling port 27, which is adapted to receive an automotive radiator cap 28. The cap 28 has an integral pressure relief valve, for controlling the development of excess pressure in the boiler. Adjacent the port 27, is an apertured lug 29 for a chain 30 preventing the cap from becoming lost from the boiler. Also in the top of the section 3 is a tapping 31 for a hose connection fitting 32. The actual end web of the section 3 has water level sight slot 33 inside which is adhered a transparent plate 34 for closing the slot. Each section of the boiler has a pair feet 35, by which the boiler is secured in the framework 40 now described.

The framework 40 is of aluminium tube. It has two trapezium shaped end frames 41. Each frame 41 consists of a length of aluminium tube, which is crush bent at the corners of the frame. One end of the tube 42 is swaged and tucked within the other end 43. This joint is at the middle of the bottom side 44 of the frames 41, which side is provided with a pair of moulded plastics material feet 45.

The bottom sides 44 of the the frames are interconnected by bottom aluminium tubes 46. The tubes—and others described below—are secured to the frames 41 by connectors similar to those described in British Patent No. 2,153,214 granted to Leslie Mark Ballamy and Audrey Mary Howard. The feet 35 of the boiler are attached by screws to the tubes 46, whereby the boiler holds the tucked joints in the frames 41 from opening. Two top tubes 47 interconnect top sides 48 of the frames 41. A moulded plastics material stepping board 49 overlies the top tubes 47, the central portions of the top sides 48 and the space therebetween. The stepping board is secured to the top side 48, which is typically 400 mm above the bottom side. The framework is triangulated by a diagonal tube 50 connected to one top side 48 and one bottom side 44.

A further tube 51 interconnects the frames 41 at one of their other sides. This tube carries via hooks 52 a steam plate 60 for use in wall paper stripping with the steam generator. This plate is largely as described in our pending patent application No. 2,248,919. However it incorporates a tube 61 extending along its length and clipped by clips 62 to the underside of the plate. One end of the tube is inserted in a fitting 63 secured in the skirt of the plate for passage of steam from a steam hose 74—described below—when connected to the steam plate via the fitting 63. The other end of the tube 61 carries a cap 64 and abuts against an integrally moulded end stop 65 on the underside of the plate. The tube 61 is perforated for escape of steam from it. When the steam plate is not in use, it can be accommodated on the steam generator at the hooks 52.

A short tube 70 depends vertically from one of the top tubes 47; whilst another short tube 71 depends diagonally from the top side 48 opposite from the one connected to the triangulating diagonal tube 50. The tubes 70 and 71 are connected to a horizontal tube 72 which carries at its ends a spool 73 for the steam hose 74 and another spool 75 for the electrical supply cable 25. Each spool has a slot 76 in one 77 of its end flanges for accommodating the free end of the hose or cable. The flange also carries a handle 78 for reeling the spool. The spool 75 for the cable 25 has in its flange a set of cut-outs 79,80 complementary to the pin arrangement of European and British 13 amp electrical plugs respectively.

It is claimed:

1. A portable steam generator comprising:

a boiler having an electric heating element therein for generating steam; and a framework within which the boiler is mounted, said framework having a top side, a bottom side, and lateral sides that are structurally interconnected, and having a stepping board mounted at the top on which a person can stand.

2. A portable steam generator according to claim 1, wherein said framework comprises a pair of planar frames, each formed as a tube with a central axis which as bent substantially lies in a plane, and spacing members interconnecting said planar frames.

3. A portable steam generator according to claim 2, wherein there are two spacing members at the top side of said frames for providing support for said stepping board.

4. A portable steam generator according to claim 2, wherein there are two spacing members at the bottom side of said frames for supporting said boiler.

5. A portable steam generator according to claim 4, wherein said frames are each a metal tube, one end of said metal tube of each frame being tucked in an other end of said tube so as to form tucked joints, and said ends being arranged between said bottom spacing members, so that securement of said boiler to said bottom spacing members prevents said tucked joints from opening.

6. A portable steam generator according to claim 2, wherein a triangulation member extends diagonally from a top side of one frame to a bottom side of the other frame.

7. A portable steam generator according to claim 1, wherein said framework is of aluminum tube and said stepping board is of moulded plastics material.

8. A portable steam generator according to claim 1, including a spool for a steam hose and a spool for an electricity supply cable.

9. A portable steam generator according to claim 1, wherein said boiler is a two section casting of light alloy, and wherein said boiler has a socket-and-spigot joint, secured by adhesive.

10. A portable steam generator according to claim 7, wherein mechanical securement of said boiler sections is additionally provided.

11. A portable steam generator according to claim 7, wherein said boiler has water sight opening and a transparent plate adhered within said boiler to close said opening.

12. A portable steam generator according to claim 1, including means for carrying a wall paper steam plate.

13. A steam generator according to claim 12, wherein the steam generator further comprises a steam plate having an apertured steam dispersion tube extending on an underside of said steam plate for connecting to a steam hose.

14. A portable steam generator, comprising:

a boiler having an electric heating element therein for generating steam; and a framework within which the boiler is mounted, said framework having a top side, a bottom side, and lateral sides that are structurally interconnected, having a pair of planar frames, each planar frame being formed as a tube with a central axis and being bent to lie substantially in a plane, and said framework having spacing members interconnecting said pair of planar frames.

* * * * *